United States Patent [19]

Davis

[11] Patent Number: 4,996,819

[45] Date of Patent: Mar. 5, 1991

[54] FILM FEED DEVICE FOR PACKAGING MACHINE

[75] Inventor: Steven D. Davis, Yuciapa, Calif.

[73] Assignee: W. A. Lane, Inc., San Bernardino, Calif.

[21] Appl. No.: 357,795

[22] Filed: May 30, 1989

[51] Int. Cl.[5] ..... B65B 9/02; B65B 57/02

[52] U.S. Cl. ..... 53/64; 53/389.4; 53/506; 53/554

[58] Field of Search ..... 53/64, 66, 389, 505, 53/506, 552, 555, 554, 553

[56] References Cited

U.S. PATENT DOCUMENTS

| | | | |
|---|---|---|---|
| 3,431,697 | 3/1969 | Phillipson et al. | 53/555 X |
| 3,995,791 | 12/1976 | Schoppee | 53/389 X |
| 4,073,121 | 2/1978 | Greenawalt et al. | 53/552 X |
| 4,077,308 | 3/1978 | Scully | 53/552 X |
| 4,144,693 | 3/1979 | Ogata | 53/552 X |
| 4,693,053 | 9/1987 | Ballestrazzi et al. | 53/64 X |

*Primary Examiner*—James F. Coan
*Attorney, Agent, or Firm*—Herb Boswell

[57] ABSTRACT

A film feed device for a form, fill and seal packaging machine includes front and rear rolls of film which are individually unwound and fed to the packaging machine via a drive assembly which contacts the rolls and rotates the same independent of other film feed mechanisms on the packaging machine. The drive assemblies contain motors which can be further controlled with sensing devices capable of sensing both when the film has been exhausted from the film roll and when the rate of output of the film from the film rolls by the drive assemblies is greater than the rate of further processing of the film in subsequent steps on the form, fill and seal packaging machine.

22 Claims, 3 Drawing Sheets

90
134
130
138
EMR. STOP
146
144
150-A
150-B
CR2
140
PULL WHEEL
CR2
132
OFF
ON
152
OPEN
154
180
136
186
ECR F
182
188
156
ECR G
OTHER
158
CLOSE
160
OFF
ON
172
184
ECR
OTHER
194
FILM FEED
OFF
ON
FEED
214
190
206
208
218
CR7
214
216
200
ECR 2
CR9
FRONT
CR7
192
204
210
CR8
212
ECR 1
202
REAR
178
ECR K
162
198
196
CR9
CR9
INDEX
FILM BYPASS
OFF
ON
220
174
168
170
166
142
128
ECR2
ECR2
CR2
CR2
222
EMR
STOP
RESET
164
176
ECR
MKRO PROCESSOR
A
B

FILM FEED DEVICE FOR PACKAGING MACHINE

BACKGROUND OF INVENTION

This invention is directed to a film feed control device and control circuits thereof which are utilized to dispense film independent from other film moving mechanisms on a form, fill and seal packaging machine.

Many commodities are packaged on form, fill and seal packaging machines. Packaging pouches are formed on these machines from rolls of polymeric or metallized film or combinations of the same. The pouches are formed, filled and sealed and then disconnected from one another from an advancing stream of pouches on the machine.

To form, fill and seal the package several individual steps or stages are utilized on the machine. First front and back films, dispensed from film rolls, are sealed together along side seams utilizing side seal bars. Next a cross seam is formed between the side seams. Normally the cross seam serves both to form the top seam of a bottom most pouch and the bottom seam of the pouch immediately above it.

After the cross seam is made between the side seams the pouch can then be filled with a product. A further cross seam is made to form the top seal on the filled pouch and concurrently as noted above the bottom seal on the next descending pouch. The completely filled and sealed pouch is then severed from the ascending stream of pouches.

The individual hardware components needed by the above described pouch machines for forming, filling and sealing the pouches include side seal bars for forming the side seals, cross seal bars for forming the cross seal, a cut off knife for separating the individual pouches from one another and a fill tube and product reservoir connected thereto for adding product to the pouches as they are formed. Additionally, some means must be provided for advancing the film through the individual component apparatuses of the machine. This is typically done utilizing "pull" wheels or rollers.

Normally, sets of opposing pull wheels are displaced below the side seal bars. After the side seams are formed by the the side seal bars these pull wheels engage the film and advance it on the machine an increment amount corresponding to the dimension of a pouch being formed on the machine. The cross seals are then formed, product is added, the side seal bars again contact the film and the film is now ready to once again be advanced or indexed by the pull wheels.

For smooth trouble free operation and for the formation of consistent pouches on a form, fill and seal pouch packaging machine, it is important that the films be pulled the correct increment amount on the machine by the pull wheels and that the orientation of the film with respect to the individual components of the machine be properly maintained. Side to side movement or other misalignment of the film can result in improperly formed and thus unusable pouches.

The pull wheels or pull rollers in engaging the film to index or move the film on the pouch packaging machine rely upon friction between the wheels and the film. Normally the pull wheels are maintained at a constant speed of rotation and moved in and out toward and away from the film via appropriate mechanical or hydraulic mechanisms. The speed of the wheels is maintained constant and the length of film moved through the machine at each index or step is governed by the time of engagement of the pull wheels with the film.

Film for the above described form, fill and seal pouch packaging machine is available from various manufacturers on rolls. These rolls are loaded on arbors on the form, fill and seal packaging machine. The film is unwound from the rolls suspended on the arbors and then feed through the individual components of the machine.

Several interrelated factors govern how much force is necessary to unroll the film from the rolls of film. A new roll of film will have a large mass of film located thereon. To unroll the film sufficient force must be applied to the film to rotate the mass of the film about the arbor. Since the film is unrolling from the roll of film at a tangent to the circumference of the roll of film, the lever arm applied to the film to induce angular acceleration to unroll the film varies as the diameter of the roll of film changes from a large diameter for a full roll of film to a small diameter for a nearly empty roll of film. Thus as film is unrolled off the roll concurrently the mass of the roll of film decreases and so does the lever arm tending to unroll the film; however, these concurrent decreases may or may not be proportional.

Additionally, some films tends to adhere more tightly to themselves in a roll compared to other films. Also uneven force may have been applied in rolling the film in the first place creating a roll of film having one edge of the film more tightly bound and/or stretched compared to the opposite edge of the film.

All of these factors influence and continually change the force necessary to unwind a roll of film. In order to insure constant and perfectly formed pouches on the pouch packaging machine, an even tension should be kept on the roll of film at all times. In order to provide such an even tension, tension devices have been incorporated on form, fill and seal packaging machines. These tension devices attempt to apply an even tension to the film such that the film can be smoothly and consistently pulled by the pull rollers.

In one prior method of applying even tension to the film being unrolled from a roll, a "dancer bar" is utilized to maintain an even constant weight on the film and thus a constant tension on the film. For the dancer bar to work properly the film must be tense not only between the pull rollers and the dancer bar, but also between the dancer bar and the roll of film. This thus required the incorporation of mechanical linkages between the dancer bar and the film roll to allow unrolling of the roll of film only at such time as insufficient film is located between the dancer bar and the film roll and to inhibit unrolling of the film when sufficient film is located between the roll of film and the dancer bar. In one such device when excess film was present the dancer bar would descend tensing a leather strap against the arbor on which the film was loaded acting as a break against rolling of further film from the roll on the arbor. In such a system the size of the roll of film which could be located on the arbor was limited to an amount of film whose mass could be inhibited from rolling by the limited friction available by the weight of the dancer bar pulling on the leather strap.

Further, prior film feed systems had no provision for identifying when a roll of film was depleted. If an operator was not monitoring the machine when the roll of film was exhausted the machine would still operate; however, instead of incorporating product in pouches since there was no film and thus no pouches the product would be dispensed onto the machine components.

Aside from wasting product this required clean up of the machine and possibly the work area prior to re-supplying the machine with new rolls of film and restart up of the operation.

Additionally, since start up of the machine requires operator attention to thread the film through the machine and insure that the side seals and cross seals are being properly formed prior to the start of product introduction, each time film must be loaded on the machine production must be halted. This naturally decreases the efficiency of operation.

In view of the above it is evident that these exists a need for new and improved film feed control devices for form, fill and seal packaging machines to insure (a) proper tension control of film being fed onto the packaging machine, (b) automatic sensing and shut down of the machine upon depletion of its supply of film and (c) longer run time intervals between re-supplying film.

BRIEF DESCRIPTION OF THE INVENTION

It is a broad object of this invention to provide for improved film feed control devices for form, fill and seal machines to provide for better tension control, automatic shut down of the machine upon exhaustion of the film supply and longer run times in between re-supplying film. These and other objects as will become evident from the remainder of this specification are achieved in a film feed control device for a form, fill and seal packaging machine of the type which includes film processing mechanisms for forming, filling and sealing film on the machine and further include film moving means for advancing film through the film processing mechanisms in conjunction with a film supply means located on the machine for containing a supply of film and a supply motor means for advancing film from the film supply means to the film processing apparatus and the film moving apparatus. The supply motor means is located on the machine independent of the film moving apparatus and is capable of being activated to advance film from the film supply means and deactivated to terminate film advancement from the film supply means.

The film feed control device of the invention can be augmented by including a control means for activating and deactivating the supply motor means. Further a first sensor means for sensing the presence and absence of film contained by the film supply means is operatively interfaced with the control means for activating the supply motor means in response to film being contained by the film supply means and deactivating the supply motor means in response to absence of film contained by the film supply means.

A film tension means for tensing the film located on the machine between the film supply means and the film processing means can be augmented with a second sensor means for sensing changes in a film tension parameter with the second sensor means operatively interfaced with the control means for activating the supply motor means in response to a first change in the film tension parameter and deactivating the supply motor means in response to a further change in the film tension parameter.

Preferably the film supply means includes at least one roll of film rotatively located on the machine and a supply motor means preferably includes at least one film roll drive assembly located on the machine in operative contact with the roll of film for rotating the roll of film on the machine. The film roll drive assembly can be constructed having a motor support, a film roll contact member and a drive motor. The motor support is constructed having opposing edges and is pivotally mounted on the machine about one of the edges in an elevated position above a roll of film. The film roll contact member is rotatively mounted on the motor support proximal to the other edge of the motor support in a position to contact a roll of film. The drive motor is located on the motor support in operative association with the film roll contact member to rotate the contact member with the rotation of the contact member in turn rotating the roll of film.

Preferably the film rolls are located on an arbor on the machine and the out of film sensor means comprises a proximity sensor located on the drive assembly for sensing the proximity of the drive assembly to the arbor.

Preferably the tension device of the machine includes a dancer bar and the tension parameter sensor includes a proximity sensor for sensing the proximity of the dancer bar to the sensor.

A control circuit for the film feed device of the invention includes an indexing means for outputting at least an indexing signal, a switch means for controlling a feed motor wherein the switch means has an on state and an off state, a sensor means incorporated in the switch means for sensing an operational parameter of the machine and switching the switch means to the off state in response to sensing of that operational parameter and a reset means for resetting the state of the switch from an off state to an on state. Further, it includes a means for integrating the index signal with the switch means whereby when the switch means is in the on state the motor is activated in response to the indexing signal.

BRIEF DESCRIPTION OF THE DRAWINGS

This invention will be better understood when taken in conjunction with the drawings wherein.

This invention utilizes certain principles and/or concepts as are set forth in the claims appended hereto. Those skilled in the arts to which this invention pertains will recognize that these principles and/or concepts are capable of being used in a variety of embodiments which may differ from the exact embodiment utilized for illustrative purposes herein. For this reason this invention is not to be construed as being limited solely to the illustrative embodiments, but should only be construed in view of the claims appended hereto.

DETAILED DESCRIPTION OF THE INVENTION

Figure 1:
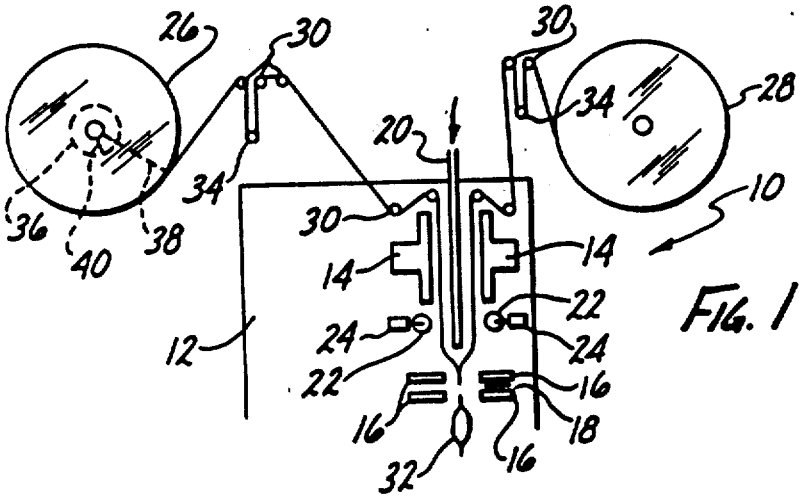
FIG. 1 is a diagrammatic elevational view of a form, fill and seal packaging machine.

Illustrated in FIG. 1 in a schematic manner is a form, fill and seal packaging machine 10. The machine 10 has a housing 12 which supports other film processing and film moving components. The film processing components include front and rear side seal bars collectively identified by the numeral 14, front and rear cross seal bars collectively identified by the numeral 16, cut off knife 18 and fill tube 20. The fill tube 20 would be connected to an appropriate product containing reservoir.

Product from the reservoir is transferred to a packaged being formed, sealed and fill on the machine 10 via the fill tube 20.

Film moving components for advancing film on the machine 10 include front and rear pull wheels or rollers collectively identified by the numeral 22. The pull rollers 22 are activated via hydraulic cylinders 24 which are under control of appropriate control solenoids, not separately numbered or shown. In a like manner the side seal bars 14, cross seal bars 16 and cut off knife 18 would also be activated via appropriate hydraulic cylinders and control solenoids (not separately numbered or shown).

In operating the form, fill and seal packaging machine 10 a rear roll of film 26 and a front roll of film 28 are fed via supply rollers collectively identified by the numeral 30 to positions between the side seals 14, the pull rollers 22, the cross seals 16 and the cut off knife 18. Once in position the side seal bars 14 are activated through several cycles to join the front and back films along vertically extending side seals. The films are advanced or indexed after each repetition until the side seals are located adjacent to the cross seal bars 16. A first cross seal is formed by activating the cross seal bars 16. Product can now be introduced into the partly formed pouch via the fill tube 20. The films are then advanced or indexed via the pull rollers 22. Repetitious cycles can now be begun.

The cross seal bars 14 are activated forming a cross seal, the side seal bars 16 are activated to form a combination top seal along a bottom most bag and a bottom seal along an elevated bag, and the bottom most bag is severed from the ascending films by the cut off knife 18. Product is then introduced via the fill tube 20 into the next partially made bag. The pull rollers 22 are then brought to bear against the film, advancing the film an increment amount. The pull rollers are then withdrawn and the cycle can then be repeated.

The above operation of the machine 10 can be placed under the control of an appropriate microprocessor such that product bags 32 are repetitively formed, filled, sealed and then dispensed from the machine 10.

It is evident from the above operation of the machine 10 that both front and back film from the rolls 26 and 28 is moved through the appropriate film processing stages, i.e. the side seal, cross seal, cut off and fill operations via the pull rollers 22 which serve as the sole film moving means. It is further evident that depending upon the amount of film located on the rolls 26 and 28, the front and back films will be under varying degrees of tension depending upon how full or empty the rolls 26 and 28 are. To compensate for this, dancer bars collectively identified by the numeral 34 in FIG. 1 can be introduced in the film path between the rollers 26 and 28 and the side seal bars 14. The weight of the dancer bars 34 are supported by the front and back films to apply a constant tension to the films, i.e. the tension equal the force imparted to the film by the weight of the dancer bars 34.

As explained above, in prior utilized form, fill and seal machines mechanical linkages were utilized between the dancer bars 34 and the front and rear rolls of film 26 and 28 in order to compensate for irregularities in withdrawing the films from the rolls 26 and 28.

Superimposed on rear film roll 26 is circular phantom line 36 representing the roll 26 after it has been partially depleted of film as well as lever line 38 for a full roll of film 26 and phantom lever line 40 for the phantom roll 36. When the roll 26 is full as shown in solid lines, the mass of the roll 26 is much greater than when it is partially emptied as shown by the phantom line 36. Thus, the frictional forces required to unroll the full roll 26 will be different from that to unroll the nearly empty roll 36. Further, the rear film being removed from the roll 26 when it is full rotates the roll 26 about the lever line 38 whereas the film being removed from the partially used roll shown by phantom line 36 rotates that roll via the phantom lever line 40. It is evident from inspection of FIG. 1 that the lever lines 38 and 40 are also quite different and thus exert different angular forces on the roll 26 (or phantom roll 36) in withdrawing film from the film roll.

Further complicating withdrawal of film from a roll of film are other subtleties such as uneven side to side tension introduced to the roll of film during manufacture. This can cause one side of the roll of film to be rolled tighter than the other. Further, a roll of film utilized on the front roller, as for instance, roll 28 can be under different tension than a roll utilized on the rear roller as, for instance roll 26 and thus one or the other of these will tend to unroll at a different rate than the other as they are drawn through the packaging machine 10 by the same pull rollers 22.

Also evident from inspection of FIG. 1 is the lack of any device on the machine 10 for indicating when a roll of film, as for instance the roll 26 or 28 is empty. If one, or both of the rolls 26 or 28 is depleted and if an operator is not in attendance the machine will keep cycling and dispensing product via the fill tube 20 toward the area of the cross seal bars 16. If the machine 10 is being operated to package food stuff sanitary conditions are required. If spillage occurs aside from the necessary clean up, resterilization of the machine may also be necessary.

Figure 2:
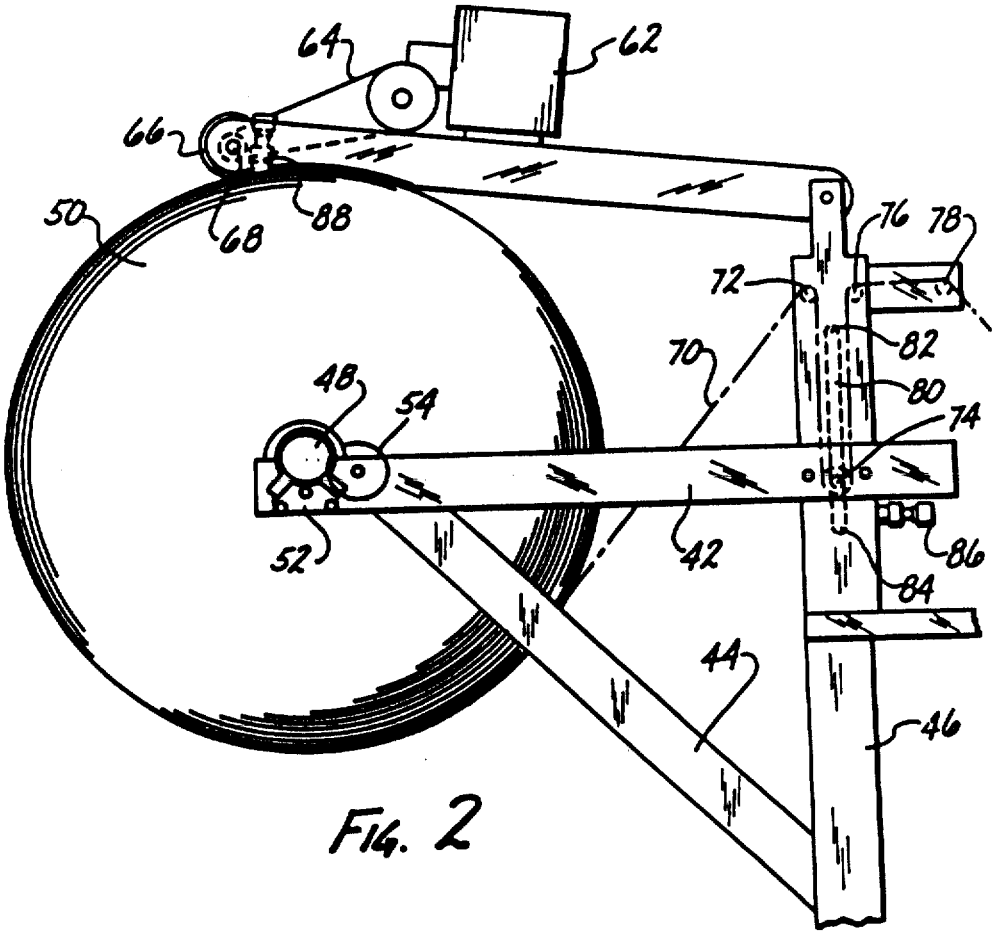
FIG. 2 is a side elevational view of a portion of a form, fill and seal packaging machine showing apparatus of the invention located thereon.

The machine 10 of FIG. 1 is modified as per this invention as is shown in FIG. 2. In FIG. 2 a modification is shown for a rear film roll utilized on a form, fill and seal packaging machine. The same type of modification would concurrently be utilized for the front film roll, however for the sake of brevity of both the specification and the drawings, only the rear roll is illustrated. The front roll and the apparatus associated therewith would be modified in an identical manner to that illustrated for the rear roll.

In FIG. 2 a cross member 42 and a support member 44 are appropriately attached to an upright member 46 on a form, fill and seal packaging machine. The cross member 42 supports a rotating arbor 48 which serves as an axle for a film roll 50. The film roll 50 represents a supply of film for a form, fill and seal packaging machine. The roll of film 50 is located on the arbor 48 for free rotation on the form, fill and seal packaging machine. The film roll 50 and its arbor 48 are supported in a bearing block 52 on the cross member 42 and locked in position via a locking cam 54.

A film roll drive assembly 56, i.e. a supply motor means for rotating the roll of film 50, is attached via a pivot axle 58 to the upright member 46. The film drive assembly 56 includes a support member 60 which is pivoted at one of its edges via the axle 58 to the cross member 46. Located on the support member 60 is a drive motor 62 which is linked via belt 64 to a roll contact member 66. The roll contact member 66 is rotatively mounted to the support member 60 via an axle 68 such that it is free to rotate on the member 60. The contact member 66 has a rubber covering on its surface which engages and make frictional contact with the film on the roll 50 for rotating the roll 50. The contact member 66 is pivoted via the axle 68 to the support member 60 on the edge opposite the pivot axle 58 such that the weight of the film drive assembly 56 rests on the film roll 50.

When the motor 62 is energized rotation of the contact member 66 is transferred to the roll 50 to rotate the roll and thus discharge film 70 from the roll. Withdrawal of the film 70 from the roll 56 is totally independent of pull wheels as, for instance, pull wheels 22 of the machine 10 of FIG. 1.

The film 70 is led across a feed roller 72 and passed underneath a dancer bar 74. From there the film is fed across a second feed roller 76 to a further feed roller 78 before being fed to other film processing mechanisms of a form, fill and seal packaging machine as, for instance, side seals, pull wheels, cross seals and the like.

Vertical slots as illustrated by the slot 80 in the upright member 46 serve as a dancer bar track. The slot 80 has an upper end 82 and a lower end 84. A constant tension is maintained on the film 70 downstream of the roller 78 via the weight of the dancer bar 74. Further, since the film is not pulled from the roll 50 by the pull wheels of the machine, but is in fact, fed from the roll 50 via the film roll drive assembly 56, tension on the film 70 downstream from the roller 78 is always constant and equal to that applied to the film by the dancer bar 74.

Film is unrolled from the roll 50 via rotation of the contact member 64. The film unrolled from the roll 50 to the feed roller 72 is taken up or tensed by the dancer bar 74 by movement of the dancer bar 74 downward in the slot 80 toward its lower end 84. Conversely film utilized by the processing components of the form, fill and seal packaging machine is pulled across the roller 78 via the pull wheels on the machine. This lifts the dancer bar 74 upward in the slot 80 under constant tension applied by the weight of the dancer bar 74. Film can be discharged from the roll 50 at a constant rate to the dancer bar 74, however, film is utilized, i.e. withdrawn from the dancer bar 74 via the rollers 76 and 78, in a stepwise manner corresponding to each cycle or index of the form, fill and seal packaging machine. Thus, a length of film is pulled across a roller 78 by the pull wheels elevating the dancer bar 74 in a step wise manner corresponding to each cycle or indexing of the form fill and seal packaging machine. Simultaneously film is fed at a constant rate from the roll 50. The dancer bar 74 thus is lifted or ascends in its slot 80 in a stepwise manner corresponding to each cycle of the machine and descends in the slot 80 in a constant manner corresponding to the rate of rotation of the roll 50 by the film drive roll assembly 56.

Since the roll contact member 66 contacts the outside circumference of the roll 50 it removes film from the roll 50 at a constant rate. Theoretically the rate of rotation of the roll contact member 66 via the motor 62 could be set to equal the rate of usage of the film by the form, fill and seal packaging machine. However, even a small difference in the rate of rolling in the roll 50 compared to the rate of the usage of the film down stream from the roller 78 can be amplified over several hours of time such that these rates are not equal. However as will be evident below, this is automatically compensated for by the mechanism of the invention.

A further advantage of this invention allows locating extra large rolls of film on a form, fill and seal package machine. A roll of film can be loaded on the machine which is much larger than that utilized on standard form, fill and seal packaging machines since the roll is only unrolled via the film roll drive assembly 56 and not via pull wheels. Thus, a very large roll can be utilized which will require a first rolling force to unroll it when it is full compared to a different second rolling force to unroll it when it is nearly empty. Since the rolling force of the invention is supplied via the film roll drive assembly and not via pull wheels very large film rolls can be utilized without concern that such large rolls are too large for a set of pull wheels to unroll.

Because the roll contact member 66 always unrolls the roll 50 via its outside circumference, while a very large full roll of film may rotate at a low RPM during unrolling and an almost empty roll of film rotate a higher RPM during unrolling the linear rate of withdrawal from the film roll 50 is always constant since the roll 50 is always rotated via force applied to its circumference and not force applied to its center.

For unattended operation of a form, fill and seal packaging machine which utilizes the film roll drive assembly of the invention, a proximity sensor 86 is located such that it senses positioning of the dancer bar 70 when it approaches the lower end 84 of the slot 80. As will be hereinafter further explained when the circuitry of the invention is discussed, if the rate of feed of the film 70 from the roll 50 to the feed roller 72 is greater than the rate of usage of the film downstream from the feed roller 78 this causes film to accumulate between the feed roller 72 and 76 and also causes the dancer bar 74 to descend. When sufficient film has accumulated between the rollers 72 and 76 to cause the dancer bar 74 to approach the lower end 84 of the slot 80, the proximity sensor 86 senses the presence of the dancer bar 74 and outputs a signal which temporarily stops the motor 62 and thus stops any further unrolling of film 70 from the roll 50. When film utilization downstream of the feed roller 78 is sufficient such that film is withdrawn between the feed rollers 72 and 76 raising the dancer bar 74 in the slot 80 the proximity sensor 86 no longer senses the presences of the dancer bar 74 in the lower portion of its slot 80 and in response thereto the motor 62 is once again activated feeding film from the roll 50 toward the feed roller 72.

By setting the speed of the motor 62 to be such that film tends to accumulate between the feed rollers 72 and 76 compared to film utilization downstream from the feed rollers 78, the dancer bar 74 and the proximity sensor 86 will continue to cycle the motor 62 off and on to always maintain an appropriate amount of film between the film rollers 72 and 76 under proper tension for utilization downstream from the rollers 78.

The proximity sensor 86 is not placed directly adjacent the lower end 84 of the slot 80 but is slightly elevated with respect to the lower end 84 of the slot 80. Thus the dancer bar 74 does not "bottom out" in the slot 80. Feed of film from the roll 50 to the motor 72 is stopped just prior to bottoming out of the dancer bar 78 in the lower end 84 of the slot 80. Because of this the dancer bar 74 is always suspended between a loop of film supported by the rollers 72 and 76. This maintains a constant tension on this loop of film and thus maintains a constant tension in the film utilized downstream from the feed rollers 78.

A further proximity sensor 88 is located on the film drive roll assembly 56 adjacent to the roll contact member 66. As film is withdrawn from the roller 50 and the diameter of the roll 50 decreases, the support member 60 pivots about the axle 68 counterclockwise as seen in FIG. 2 maintaining the film contact member 66 against the surface of the roll 50. When the roll 50 has been depleted such that the proximity sensor 86 is positioned adjacent to the arbor 48, the proximity sensor 86 outputs a signal in response to sensing the arbor 48. As hereinafter explained, this signal is utilized to shut off all operations of the form, fill and seal machine. Thus product is not wasted by dispensing product to non existing pouches and the sanitary condition of the machine is maintained.

Because of the automatic shut off feature of the proximity sensors 88 and the automatic tension feature of the proximity sensor 86 a form, fill and seal packaging utilizing the invention can run unattended for a period of time governed only by the size of the roll of film 50 loaded on the machine. Since shut down to constantly reload smaller rolls of film and constant operator attention are eliminated use of a form, fill and seal packaging machine utilizing the invention is more economical compared to other prior machines.

The proximity sensor 86 can be considered as sensing a parameter associated with film tension, hereinafter referred to as a "slack parameter", and the proximity sensor 88 can be considered as sensing a different machine operation parameter associated with presence or absence of a film, hereinafter referred to as a "film run out parameter".

Figure 3:
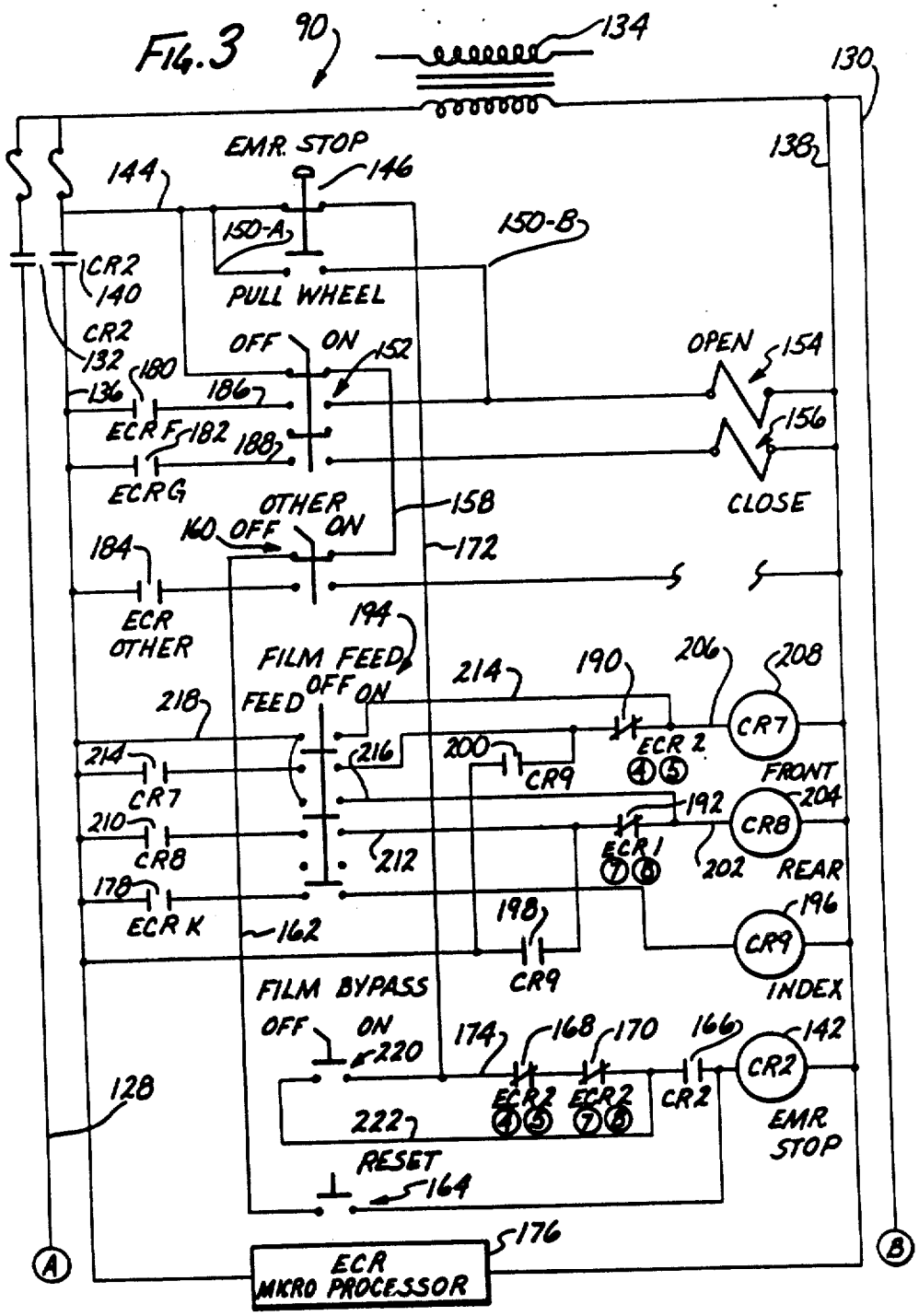
FIG. 3 is an electrical schematic for controlling the apparatus of FIG. 2.
Figure 4:
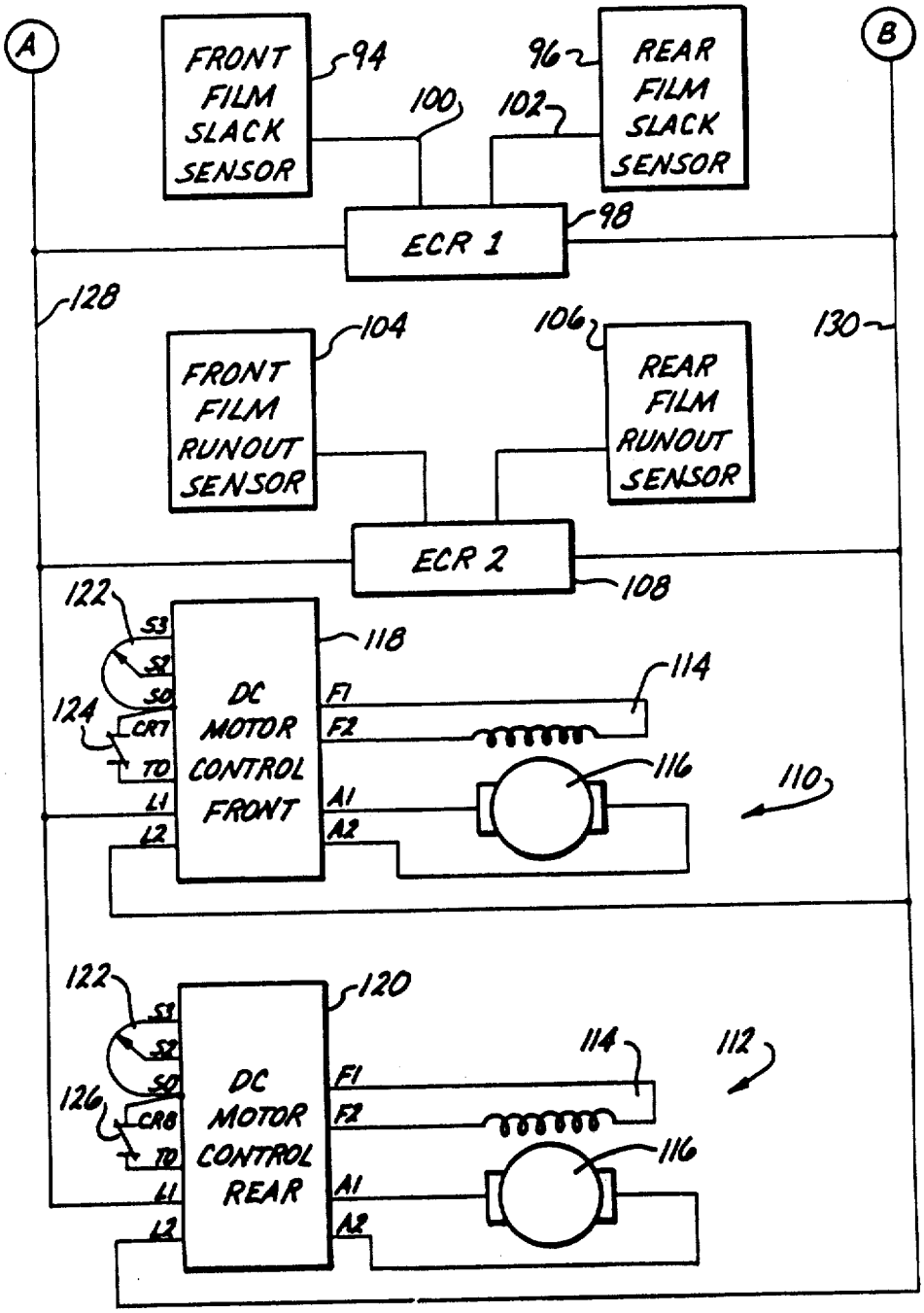
FIG. 4 is a continuation of the electrical schematic of FIG. 3.

FIGS. 3 and 4 show a circuit suitable for use on a form, fill and seal packaging machine which utilizes both a film run out sensor and a film slack sensor for both a front and rear roll of film located on the machine wherein the machine includes a film roll drive assembly as was illustrated in FIG. 2 on both the front and rear rolls of film. The circuit 90 of FIG. 3 and the circuit 92 of FIG. 4, are continuous as per the connectors A and B of these respective circuits. Prior to discussing the portion of the overall circuit shown by the circuit 90 of FIG. 3 discussion of the individual components of the portion of the overall circuit shown by the circuit 92 of FIG. 4 will facilitate further understanding of the invention.

In circuit 92 a front film slack sensor 94 and a rear film slack sensor 96 corresponding to the proximity sensor 86 of FIG. 2 are connected to electronic control relay 98, i.e. "ECR 1", via connectors 100 and 102. The electronic control relay 98 is a dual relay capable of outputting a control signal responsive to either a signal received from the front film slack sensor 94 or a signal received from the rear film slack sensor 96.

In a like manner front film run out sensor 104 and rear film run out sensor 106 feed signal to electronic control relay 108, i.e. "ECR 2". The front film run out sensor 104 and rear film run out sensor 106 thus correspond to the proximity sensor 88 of FIG. 2. As per the electronic control relay 98, the electronic control relay 108 is capable of outputting a dual signal in response to the dual input signals from the sensors 104 and 106.

Suitable as the sensors 94, 96, 104 and 106 are sensors manufactured by Turck and identified by product number B15-G18-AN6X-B1341. Suitable for use for the electronic control relays 98 and 108 are Turck control relays MS81-221-RX2.

A front motor 110 and a rear motor 112 corresponding to the drive motor 62 of FIG. 2 are further shown in FIG. 4. Each of these motors includes an appropriate field coil collectively identified by the numeral 114 and an appropriate armature collectively identified by the numeral 116. These are connected to respective DC motor controllers 118 and 120 for the front and rear respectively. Each of the motor controllers 118 and 120 include a speed control collectively identified by the numeral 122. Further, front motor control 118 is under the control of relay points 124, i.e. "CR7" of FIG. 4, and rear motor controller 118 is under the control of rear relay points 126, i.e. "CR8" of FIG. 4.

Suitable for the controllers 118 and 120 are Minarik RG100UC DC motor controllers. These motor controllers operate to activate the motors 110 and 112 when the circuit between pins "SO" and "TO" is open, that is when the relay contacts or points 124 or 126 are open they activate the motors 110 and 112 respectively and when they are close they deactivate or turn off the motors 110 and 112. Thus, to activate the motor 110 the circuit across the relay points 124 is opened and to deactivate it the circuit across the points 124 is closed. Likewise for the motor 112. Speed of operation of the motors 110 and 112 are governed by the settings of the speed control 122 across pins "SO", "S2" and "S3" of the respective controllers 118 and 120.

Power to circuit 92 of FIG. 4 is via bus 128 and 130 which extends across the circuits 90 and 92 of FIGS. 3 and 4. Buss 128 is controlled via a set of relay points or contacts 132. Opening of the relay points 132 disrupts the circuit 92 turning off the motors 110 and 112.

A transformer 134 in circuit 90 of FIG. 3 supplies power to bus 128–130 as well as to bus 136 and its return bus 138. As with bus 128, bus 136 is controlled via a set of relay or contact points, relay points 140. Relay points 132 and 140 are part of a multiple contact relay 142 designed in FIG. 3 as relay "CR2" with the same designation carrying over to the relay points 132 and 134 indicating that they are controlled by relay 142. The relay 142 serves as an emergency stop relay for the totality of the circuits 90 and 92 of FIGS. 3 and 4 Connecting to bus 136 before relay points 140 is line 144. Line 144 feeds an emergency stop switch 146 as well as reset line 148 and emergency pull wheel open line 150-A and 150-B.

A pull wheel switch 152 controls the pull wheels. Switch 152 in its off position serves as a bypass for a reset mechanism. The pull wheel switch 152 governs operation of a pull wheel open solenoid 154 as well as a pull wheel close solenoid 156. If an emergency stop is required a circuit to the pull wheel open solenoid 154 is completed via the emergency stop switch 146 completing the circuit between line 150-A and line 150-B to activate the pull wheel open solenoid 154. When the emergency stop switch 146 is in a normal off position the circuit between lines 150-A and 150-B is open thus deactivating the emergency stop function of the pull wheel open solenoid 154.

When the pull wheel off switch 152 is in the off position, a circuit is completed through the switch from line 148 to line 158. Line 158 passes through a further switch 160 identified as "other" in FIG. 3. For the purposes of this specification switch 160 is used as a generic switch similar in operation to pull wheel switch 152. Switch 160 is used to generically represent several further switches (the function of which is standard to form, fill and seal machines) which govern the operation of such standard film processing apparatuses of a form, fill and seal packaging machine such as the side seals, the cross seals, the knife switch, product feed pump, fill tube open solenoid, film break devices and other like devices necessary for the operation of the form, fill and seal packaging machine. When the pull wheel switch 152 and the totality of these other apparatuses represented by the "other" switch 160 are in an off position, a circuit is completed via line 162 to reset switch 164. Stated in other terms, the individual apparatuses of the form, fill and seal packaging machine, i.e. the cross seals, side seals, knife switch, etc., would each be controlled by an individual switch similar to the pull wheel switch 152. These are wired in series with one another in lines 148, 158, 160 as is the pull wheel switch 152 and the "other" switch 160 such that they all must be in an off position in order to complete the circuit through lines 148, 158 and 162 to the reset switch 164.

When all of the apparatus switches, i.e. the pull wheel switches 152 and the other apparatus switches, generically indicated by the "other" switch 160 are in an off position, and reset switch 164 is depressed, a circuit is completed to relay 142. Relay 142 is activated closing the relay points 132 and 140 in the bus lines 128 and 136 as well as closing relay points 166 wired in parallel with the relay switch 164. Relay points 166 are part of relay 142. Thus once the relay 142 is activated a circuit through one of its set of relay points, points 166, can be used to maintain relay 142 in an activated state.

The electronic control relay 108 has two sets of output contacts, "ECR2 4-5" and "ECR2 7-8" which comprise relay points 168 and 170 respectively. These are normally closed as is indicated in FIG. 3. A line 172 leads from emergency switch 146 to line 174 which connects the relay points 166, 168 and 170 to the bus 136 via switch 146 to supply current to the relay 142.

Once the relay 142 is closed via the reset switch 164 it is maintained in a closed position via lines 172 and 174 and the closed relay points 166, 168 and 170. Thus, points 166 of relay 142 serve to maintain relay 142 closed once it is closed via the reset switch 164. If, however, emergency stop switch 146 is activated, the circuit between lines 144 and 172 is disrupted. In response to this relay 142 is opened opening its relay contact points 166. If the emergency stop switch 146 is then returned to an off position completing a circuit from line 144 to line 172 since the relay points 166 are now open, the relay 142 will remain open until it is once again closed by the reset switch 164. The reset switch 164, however, cannot reset the relay 142 until all of the apparatus switches, i.e. the pull wheel switch 152 and the other apparatus switch indicated by generic switch 160 are returned to an off position completing the circuit through line 162 to the reset switch 164.

Contact points 132 and 140 in bus lines 132 and 136 are also part of and thus controlled by the relay 142. Thus, once the relay 142 is activated concurrently with closing of contacts 166 on line 174 is closure of contacts 132 to activate the bus 128 and closure of contacts 140 to activate the bus 136. It is thus evident that if relay 142 is opened by disrupting the circuit through the emergency switch 146 from line 144 to line 172, the buses 128 and 136 are opened and all components connected to those buses are thus taken out of circuit. This serves as an emergency stop for the motors 110 and 112 as well as for stopping all other functions except the pull wheel open solenoid 154 as explained above.

As noted above the electronic control relay 108 is tied to the film run out sensors 104 and 106. If one of the proximity sensors of a film roll drive assembly corresponding to proximity sensor 88 indicates an out of film condition on the roll of film it is associated with, a signal from the appropriate sensor 104 or 106 to the electronic control relay 108 results in opening of relay points 168 for a run out condition for the front film supply or relay 170 for a run out condition of the rear film supply. Run out of either film supply will open the appropriate electronic relay point either points 168 or points 170 disrupting the circuit through line 174. This, in turn, will disrupt the circuit to the relay 142 opening the same. Once the relay 142 is opened its control points 166 are opened maintaining the relay 142 in an open condition. This also opens points 132 and 136 disrupting the circuits to the buses 128 and 130 stopping all component of the form, fill and seal packaging machine such that product is not wasted or spilled.

The electronic relay points 168 and 170 as well as other electronic relay points hereinafter identified are normally chosen as optically coupled electronic relays as, for instance, optical couple relays OAC 15 manufactured by the Opto 22 company. The relays 168 and 170 would normally be in a closed condition and would be opened upon signal from one of the run out sensors 104 and 106. This would disrupt the supply circuit to the relay 142. While the relays 168 and 170 would return to their quiescent closed state when the circuit along the bus 128 was disrupted by opening of the contact points 132, since the circuit through the contact points 166 is in series with the points 168 and 170 and since the points 166 would remain open, the relay 142 would remain in an off state once a film run out condition is sensed. This film run out condition thus can not be over ridden until the circuit through relay 142 is re-established through the reset switch 164.

A microprocessor 176 is connected across buses 136 and 138. It has multiple outputs controlling the individual functions of the form, fill and seal packaging machine. Suitable as the microprocessor 176 is a Durant 6500 manufactured by American Autogard, Rockford, Ill. or an Eaton 6450, manufactured by Eaton, Watertown, Wisc. While the microprocessor 176 would have multiple outputs, for the purposes of this specification only several of these need to be considered. The first of these is an indexing signal. This indexing signal controls electronic relay points 178, i.e. relay points "ECR K" in FIG. 3. It further controls electronic relay points 180, i.e. "ECR F", and relay points 182, i.e. "ECR G", associated with the pull wheel switch 152. Additionally the other electronic relay points which would be controlled by the microprocessor 176 are noted by generic relay point 184 coupled to the generic "other" switch 160. These would be utilized to activate the other individual apparatuses of the form, fill and seal packaging machine, i.e. side seals, cross seals and the like. Operation of these would be in a manner similar to the operation described for the pull wheels, i.e. relays 180 and 182 and the index signal, i.e. relay 178.

With the emergency stop switch in the off position and all other apparatus switches also in the off position, i.e. pull wheel switch 156 and generic "other switch 160, the circuit can be activated by the reset button 164 as explained above. This activates the bus 136 upon closure of relay points 140. Signals from the microprocessor 176 are then utilized to open and close the pull wheels by activating line 186 connected to relay points 180 and line 188 connected to relay points 182 to open and close the pull wheel solenoids 154 and 156. The pull wheel solenoid 156 can only be activated to close the pull wheels during normal operation of the device. As was explained above during an abnormal emergency stop the pull wheel solenoid 154 is activated via the emergency switch 146 and since at this time bus line 136 is deactivated irrespective of the position of the pull wheel switch 152 the pull wheel close solenoid 156 is deactivated.

Electronic control relay points 190, i.e. "ECR1 4-5", and electronic control relay points 192, i.e. "ECR1 7-8", controlled by the electric control relay 98 are normally in a closed position as is seen in FIG. 3 in a like manner as explained for the contacts 168 and 170. If, a film slack condition is sensed, i.e. a film tensing dancer bar descends, it is sensed by a proximity sensor 86. This condition will open relays points 190 or 192 depending upon whether or not its the front film or the rear film which is slacked. The relays points 190 and 192, however, are not in the main control circuit as were the run out relay points 168 and 170 for the film run out condition described above.

An indexing signal from the microprocessor 176 across the electronic control relay points 178, i.e. "ECR K", and through a film feed switch 194 activates an indexing relay 196, i.e. "CR 9", if the film feed switch 194 is in the on position. The relay 196 has two sets of output contact points, points 198 and 200 (both identified by the alpha numeric "CR 9" in FIG. 3). With the film feed switch 194 in an on position current through the relay 196 closes the points 198. Current can then flow through the points 198 to line 202 via the electronic relay points 192 to activate a rear motor control relay 204. In a like manner current through the other set of index relay points 200 passing through closed electronic control relay points 190 activates line 206 to activate a front motor relay 208. When the rear motor relay 204 is activated it closes relay points 210, i.e. "CR 8", feeding line 212 which is in parallel with the relay points 198. When relay points 210 are closed this maintains the rear motor relay 208 activated.

In a like manner when relay 208 is activated it closes relay points 214, i.e. "CR 7", to maintain the front motor relay 208 activated.

To activate the relays 204 and 208, an index signal from the microprocessor 176 is needed. This index signal activates relay 196 which in turn activates the relays 204 and 208. Once activated the relays 204 and 208 close their respective points 210 and 214. The relay points 210 and 214 respectively now maintain the relays 204 and 208 in an active state. Now even when the index signal goes low from the microprocessor 176 opening the electronic control points 178 and deactivating the relay 176 the motor relays 204 and 208 stay activated via the parallel circuits through the contact points 210 and 214.

If slack is detected in either the front or the rear films by an appropriate dancer bar proximity sensor corresponding to sensor 86, this will open either the electronic relay control points 192 for the rear film or the points 190 for the front film. If, for instance the points 192 are opened upon indication of a slack condition in the film on the rear film roll, the circuit via the relay points 210 to the relay 204 is opened deactivating the relay 204. This, of course, opens the points 210 to maintain the relay 204 in an opened or off state.

The relay points 126 connected across pins "SO" and "TO" of the rear motor controller 120 are connected to the relay 204. As was noted above, when the relay points 126 are opened, the rear motor 122 is turned on. Thus, when the relay 204 is activated concurrently with closing the relay points 210 which maintains the relay 204 activated, the points 126 are open to activated the rear motor 112. As a result the rear motor 112 is activated or placed into an on state concurrently with closing of the relay 204. In a like manner the front mofor 110 is activated concurrently with activating the relay 208. When the relay 204 is inactivated the points 126 close stopping the motor 112 and when the relay 208 is inactivated the points 124 close stopping the motor 110.

Again referring to the rear drive only, assuming that slack was detected by the proximity sensor 96 causing the relay points 192 to open, this would disrupt the line to the relay 204 turning the same off. Turning the relay 204 off closes the points 126 across the DC motor controller turning the motor 112 off. While the motor 112 is deactivated the remainder of the circuit for the form, fill and seal packaging machine is still actively functioning, i.e. the side seals, pull wheels, the cross seals, etc.

The microprocessor 176 sends an index signal to the index relay 196 via the contact points 178 for each machines cycle, however, as long as the contact points 192 remain open, the relay 204 will remain inactivated. At such time as the slack is taken up in the film, and the rear film slack sensor 196 no longer detects its dancer bar, the contacts 192 close. On the next machine cycle in response to the next index signal the contacts 178 controlling the index relay 196 are closed activating the index relay 196. This closes the points 198 which, in conjunction with the closed points 192, now reactivates the rear motor relay 204. Once it is reactivated the rear motor relay 204 opens the contact 126 turning the rear motor 112 on. In a like manner the points 190 would open on detecting a front slack film condition inactivating the relay 208. Relay 208 will only be reactivated when both the contacts 190 are closed and a new indexing signal is output by the microprocessor 176 to activate the index relay 196.

As opposed to the all or nothing effect of the film run out sensors 104 and 106 opening the contacts 168 or 170, the film slack sensors 94 and 96 cycle the motors 110 and 112 off and on respectively to maintain an even tension in the film being processed.

During loading of new rolls of film on the form, fill and seal machine switching of a film feed switch 194 to a "feed position" closes the circuit to lines 214 and 216 via line 218 which is directly linked to bus 136. This activates the relays 204 and 208 respectively irrespective of lack of an index signal and irrespective of the state of film slack proximity sensors 94 and 96. Once the film is properly loaded on the machine the film feed switch 194 is switched from the feed position disrupting the connection between the lines 214 and 216 to line 218 rendering the control relays 204 and 208 once again under the control of the slack sensors 94 and 96 and the index relay 196.

Further, it is sometimes desirous to run certain components of a machine without any film on the machine, as for instance during sterilization of the machine. Normally with no film on the machine the run out sensors 104 and 106 would be activated opening the electronic relay points 168 and 170 and inactivating the emergency stop relay 142. To get around this condition a film bypass switch 220 is switched to an on position completing a circuit through line 222 to the relay points 166. Upon completion of a circuit to the relay 142 via the reset button 164 the relay 142 is maintained in an activated state via the circuit through line 222. At such time as the film override condition is finished, i.e. sterilization of the machine is complete, switching the film bypass switch to the off position disrupts the circuit through line 222 inactivating the relay 142.

I claim:

1. A film feed control device for a form, fill and seal packaging machine of the type including film processing means for forming, filling and sealing film on said machine and further including film moving means for advancing film through said film processing means, said control device comprising:

film supply means located on said machine for containing a supply of film;

supply motor means for advancing film from said film supply means to said film processing means and said film moving means, said supply motor means located on said machine independent of said film moving means, said supply motor means capable of being activated to advance film from said film supply means and deactivated to terminate film advancement from said film supply means;

control means for activating and deactivating said supply motor means;

first sensor means for sensing the presence and absence of film contained by said film supply means; and said first sensor means operatively interface with said control means for activating said supply motor means in response to film being contained by said film supply means and deactivating said supply motor means in response to absence of film contained by said film supply means.

2. A control device of claim 1 wherein:

said film supply means includes at least one roll of film rotatively located on said machine; and said supply motor means includes at least one film roll drive assembly, said roll drive assembly in operative contact with said roll of film for rotating said roll of film on said machine.

3. A control device of claim 1 including:

said machine having a film roll arbor;

said film supply means includes at least one roll of film rotatively located on said arbor; and said first sensor means comprises a sensor located on said supply motor means for sensing the proximity of said supply motor means to said arbor.

4. A control device of claim 1 including:

film tension means for tensing said film, said film tension means located on said machine between said film supply means and said film processing means.

5. A control device of claim 1 including:

film tension means for tensing said film, said film tension means located on said machine between said film supply means and said film processing means;

second sensor means for sensing changes in a film tension parameter; and said second sensor means operatively interface with said control means for activating said supply motor means in response to a first change in said film tension parameter and deactivating said supply motor means in response to a further change in said film tension parameter.

6. A device of claim 5 wherein:

said film tension means includes a tensor member, said tensor member movable on said machine;

said tension parameter comprises positional changes of said tensor member in response to movement of said tensor member; and said second sensor means for sensing said positional changes of said tensor member.

7. A control device of claim 6 including:

said tensor member comprises a dancer bar;

said film tension means further includes a vertically oriented elongated dancer bar track, said dancer bar vertically movable in said dancer bar track; and said second sensor means sensing movement of said dancer bar to and from a depressed position in said dancer bar track whereby said supply motor means is deactivated in response to depression of said dancer bar in said dancer bar track and activated in response to elevation of said dancer bar in said dancer bar track.

8. A control device of claim 7 wherein:

said dancer bar track comprises opposing support members having elongated slots therein, said slots having ends, said dancer bar vertically movable in said slots between said ends.

9. A control device of claim 6 including:

said film tension means includes a tensor member movable on said machine; and said second sensor means comprises a sensor fixedly mounted on said machine for sensing the proximity of said tensor member.

10. A film feed control device for a form, fill and seal packaging machine of the type including film processing means for folding, filling and sealing film on said machine and further including film moving means for advancing film through said film processing means, said control device comprising:

film supply means located on said machine for containing a supply of film;

supply motor means for advancing film from said film supply means to said film processing means and said film moving means, said supply motor means located on said machine independent of said film moving means, said supply motor means capable of being activated to advance film from said film supply means and deactivated to terminate film advancement from said film supply means;

said film supply means including two rolls of film, each of said rolls of film located on said machine so as to rotate on said machine; and said supply motor means includes two film roll drive assemblies, each of said drive assemblies in operative contact with one of said respective rolls of film for rotating said respective roll of film on said machine.

11. A control device of claim 10 including:

each of said film roll drive assemblies having a motor support, a film roll contact member and a drive motor;

said motor support having opposing edges and pivotally mounted on said machine about one of said edges in an elevated position over one of said respective rolls of film;

said film roll contact member rotatively mounted on said motor support proximal to the other of said edges of said motor support in a position to contact said respective roll of film; and said drive motor located on said motor support in operative association with said film roll contact member to rotate said contact member, said rotation of said contact member rotating said respective roll of film.

12. A control device of claim 10 including:

film tension means for tensing said film, said film tension means located on said machine between said film supply means and said film processing means;

sensor means for sensing changes in a film tension parameter; and said sensor means operatively interface with said control means for activating said supply motor means in response to a first change in said film tension parameter and deactivating said supply motor means in response to a further change in said film tension parameter.

13. A film feed device for a form, fill and seal packaging machine comprising:

front and back film supply rolls located on said machine, each of said film supply rolls containing a supply of film;

front and back film roll drive assemblies, said front roll drive assembly in operative contact with said front film supply roll for rotating said front film supply roll on said machine, said back roll drive assembly in operative contact with said back film supply roll for rotating said back film supply roll on said machine;

said machine having front and back film roll arbors;

said film supply rolls rotatively located on said respective arbors;

said device including front and back proximity sensors; and said sensors located on said respective drive roll assemblies for sensing the proximity of said drive roll assemblies to said respective arbors.

14. A film feed control device for a form, fill and seal packaging machine of the type including film processing means for forming, filling and sealing film on said machine and further including film moving means for advancing film through said film processing means, said control device comprising:

film supply means located on said machine for containing a supply of film;

supply motor means for advancing film from said film supply means to said film processing means and said film moving means, said supply motor means located on said machine independent of said film moving means, said supply motor means capable of being activated to advance film from said film supply means and deactivated to terminate film advancement from said film supply means;

control means for activating and deactivating said supply motor means; and said control means includes a microprocessor means for outputting at least an indexing signal for said film processing means, a switch means for controlling said supply motor means, a reset means for resetting the state of said switch means between an on state and an off state, and a means for integrating said indexing signal with said switch means whereby when said switch means is in said on state said supply motor means is activated in response to said indexing signal.

15. A control device of claim 14 wherein:

said microprocessor means further output signal for controlling said film moving means.

16. A control device of claim 14 including:

film tension means for tensing said film, said film tension means located on said machine between said film supply means and said film processing means; and said switch means having sensor means for sensing at least one of (a) the presence and absence of film contained by said film supply means and (b) a change in a film tension parameter associated with said film tension means, said sensor means outputting a signal in response to said at least one of (a) the presence and absence of film contained by said film supply means and (b) a change in a film tension parameter associated with said film tension means.

17. A control device of claim 16 wherein:

said switch means further includes a relay means having an on and an off position for controlling a circuit, said relay means operatively connected to said microprocessor means for receiving said indexing signal to set said relay means in said on position and further operatively connected to both said sensor means and said reset means whereby said relay means is set to said off position in response to said output signal of said sensor means and further is set to said off position in response to resetting the state of said switch means to said off state.

18. A control device of claim 14 including:

film tension means for tensing said film, said film tension means located on said machine between said film supply means and said film processing means;

said switch means having a first sensor means for sensing the presence and absence of film contained by said film supply means and a second sensor means for sensing a change in a film tension parameter associated with said film tension means;

said first sensor means outputting a signal in response to the presence and absence of film contained by said film supply means and second sensor means outputting a signal in response to a change in a film tension parameter associated with said film tension means;

said switch means further includes a relay means having an on and an off position for controlling said film supply motor means, said relay means positional between said on and off positions, in said on position said relay means activating said film supply motor means and in said off position said relay means deactivating said film supply motor means; and said relay means operatively connected to said microprocessor means for receiving said indexing signal to position said relay means in said on position and further operatively connected to said first and said second sensor means and to said reset means whereby said relay means is positioned in said off position in response to said output signals of said first and second sensor means and further positioned in said off position in response to resetting the state of said switch means to said off state.

19. A control circuit for a motor on a form, fill and seal packaging machine comprising:

indexing means for outputting at least an indexing signal;

a switch means for controlling said motor, said switch means having an on state and an off state;

said switch means including sensor means for sensing an operation parameter of said machine, said sensor means switching said switch means to said off state in response to sensing of said operation parameter;

a reset means for resetting the state of said switch means from said off state and said on state; and a means for integrating said indexing signal with said switch means whereby when said switch means is in said on state said motor is activated in response to said indexing signal.

20. A control circuit of claim 19 including:

said switch means having a first sensor means for sensing a first machine operation parameter and a second sensor means for sensing a second machine operation parameter; and said first sensor means outputting a signal in response to detection of said first machine operation parameter and said second sensor means outputting a signal in response to detection of said second machine operation parameter.

21. A control circuit of claim 20 wherein:

said switch means further includes a relay means for controlling said motor, said relay means positional between on and off positions, in said on position said relay means activating said motor and in said off position said relay means deactivating said motor; and said relay means operatively connected to said indexing means for receiving said indexing signal to position said relay means in said on position and further operatively connected to said first and said second sensor means and to said reset means whereby said relay means is positioned in said off position in response to said output signals of said first and second sensor means and further positioned in said off position in response to resetting the state of said switch means to said off state.

22. A film feed device for a form, fill and seal packaging machine comprising:

front and back film supply rolls located on said machine, each of said film supply rolls containing a supply of film;

front and back film roll drive assemblies, said front roll drive assembly in operative contact with said front film supply roll for rotating said front film supply roll on said machine, said back roll drive assembly in operative contact with said back film supply roll for rotating said back film supply roll on said machine;

each of said film roll drive assemblies having a motor support, a film roll contact member and a drive motor;

said motor support having opposing edges and pivotally mounted on said machine about one of said edges in an elevated position over one of said respective film supply rolls;

said film roll contact member rotatively mounted on said motor support proximal to the other of said edges of said motor support in a position to contact said respective film supply roll; and said drive motor located on said motor support in operative association with said film roll contact member to rotate said contact member, said rotation of said contact member rotating said respective film supply roll.

* * * * *